US011459148B2

(12) United States Patent
Kim

(10) Patent No.: US 11,459,148 B2
(45) Date of Patent: Oct. 4, 2022

(54) FIXING DEVICE FOR FOLDED PASTE TUBE SUCH AS TOOTHPASTE

(71) Applicant: Dong Ik Kim, Incheon (KR)

(72) Inventor: Dong Ik Kim, Incheon (KR)

( * ) Notice: Subject to any disclaimer, the term of this patent is extended or adjusted under 35 U.S.C. 154(b) by 0 days.

(21) Appl. No.: 17/295,435

(22) PCT Filed: Nov. 8, 2019

(86) PCT No.: PCT/KR2019/015191
§ 371 (c)(1),
(2) Date: May 20, 2021

(87) PCT Pub. No.: WO2020/105919
PCT Pub. Date: May 28, 2020

(65) Prior Publication Data

US 2022/0009675 A1 Jan. 13, 2022

(30) Foreign Application Priority Data

Nov. 21, 2018 (KR) ..... 10-2018-0144929

(51) Int. Cl.
*B65D 35/56* (2006.01)

(52) U.S. Cl.
CPC ..... *B65D 35/56* (2013.01)

(58) Field of Classification Search
CPC ..... B65D 35/56; B65D 35/247; B65D 35/00–565; B65D 63/00–18
USPC ..... 222/105, 95
See application file for complete search history.

(56) References Cited

U.S. PATENT DOCUMENTS 607,530 A * 7/1898 Taylor ..... B65D 35/32 222/99
1,310,083 A * 7/1919 Huntoon ..... B65D 35/32 222/99
1,537,010 A * 5/1925 Herschmann ..... B65D 35/02 222/99
1,559,565 A * 11/1925 Farnum ..... B65D 35/32 222/99

(Continued)

FOREIGN PATENT DOCUMENTS

JP 5505842 B2 5/2014
JP 6245746 B2 12/2017

(Continued)

OTHER PUBLICATIONS

International Search Report for PCT/KR2019/015191 dated Feb. 18, 2020 from Korean Intellectual Property Office.

*Primary Examiner* — Paul R Durand
*Assistant Examiner* — Michael J. Melaragno
(74) *Attorney, Agent, or Firm* — Revolution IP, PLLC

(57) ABSTRACT

A fixing device for a folded paste tube such as toothpaste, includes a tube bottom end formed on one end of the tube to have a certain width and length and a pair of hook parts formed on one surface of the tube bottom end to face each other in a tilted direction along a perforated line cut from one side to the other side in a horizontal direction and the tilted direction, and binding parts formed inside the hook parts, wherein the hook parts are cut along the perforated line, the hook part on one side and the hook part on the other side are unfolded and surround a rolled and folded part of the tube bottom end, and the binding parts come into contact with each other so as to allow hooks to be held by each other.

1 Claim, 2 Drawing Sheets

(56) References Cited

U.S. PATENT DOCUMENTS 1,603,423 A * 10/1926 Spitler ..... B65D 35/32 222/99
1,987,428 A * 1/1935 Whiteman ..... B65D 35/32 222/99
2,083,603 A * 6/1937 Harwick ..... B65D 35/28 222/95
2,413,323 A * 12/1946 Hills ..... B65D 35/02 222/107
3,057,535 A * 10/1962 Thompson ..... B65D 5/3621 229/117
3,248,012 A * 4/1966 Adams ..... B65D 35/28 222/95
3,313,455 A * 4/1967 Kemmer ..... B65D 35/28 222/103
3,865,304 A * 2/1975 Mojonnier ..... B65D 33/30 383/82
4,159,787 A * 7/1979 Wright ..... B65D 35/28 222/103
4,166,571 A * 9/1979 Niedecker ..... B65D 33/1641 24/115 A
4,574,951 A * 3/1986 Weaver ..... B65D 75/5816 206/461
4,817,823 A * 4/1989 Sparr, Sr. ..... B65D 35/28 222/103
4,818,120 A * 4/1989 Addiego ..... B65D 33/30 383/5
4,830,272 A * 5/1989 Wear ..... B65D 5/4802 229/120.07
4,928,851 A * 5/1990 Eatherly ..... B65D 35/28 222/103
5,108,008 A * 4/1992 Ryder ..... B65D 35/32 132/247
5,277,335 A * 1/1994 Okami ..... B65D 35/28 222/102
5,373,968 A * 12/1994 Nelson ..... B65D 35/32 222/107
5,549,221 A * 8/1996 Conlee ..... B65D 35/28 222/103
5,579,956 A * 12/1996 Seale ..... B65D 35/18 222/107
5,743,434 A * 4/1998 Light ..... B65D 35/28 222/103
5,782,385 A * 7/1998 Soon ..... B65D 35/28 222/103
5,857,593 A * 1/1999 Patronaggio ..... B65D 35/28 222/103
5,920,967 A * 7/1999 Souza ..... B65D 35/28 24/563
5,975,363 A * 11/1999 Haycock ..... B65D 35/28 222/103
6,302,298 B1 * 10/2001 Chernov ..... B65D 35/28 222/103
6,415,479 B1 * 7/2002 Steinberg ..... B65D 35/32 222/103
6,561,385 B1 * 5/2003 Jacobs ..... B65D 35/32 222/103
6,685,057 B1 * 2/2004 Sullivan ..... B65D 35/32 222/95
6,749,087 B1 * 6/2004 Robinson ..... B65D 35/28 222/1
7,971,752 B2 * 7/2011 Truxes ..... B65D 35/28 222/92
9,902,528 B2 * 2/2018 Jaouen ..... B01F 13/0022
10,912,427 B1 * 2/2021 Szajnert ..... A61J 1/035
2002/0047022 A1 * 4/2002 Chernov ..... B65D 35/28 222/103
2005/0029294 A1 * 2/2005 Jackson ..... B65D 35/18 222/95
2005/0269358 A1 * 12/2005 Choi ..... B65D 35/28 222/103
2007/0113453 A1 * 5/2007 Dickinson ..... B65D 33/001 40/673
2007/0131710 A1 * 6/2007 Requardt ..... B65D 35/28 222/103
2012/0187147 A1 * 7/2012 Lightfoot ..... B65D 35/28 222/103

FOREIGN PATENT DOCUMENTS

KR 20-1999-0004633 U 2/1999
KR 20-0324669 Y1 8/2003
KR 10-2004-0079880 A 9/2004

* cited by examiner

FIXING DEVICE FOR FOLDED PASTE TUBE SUCH AS TOOTHPASTE

TECHNICAL FIELD

The present invention relates to a fixing device configured to fold and fix a tube bottom end to allow the contents to be squeezed well after using tube-type toothpaste, not to unfold the tube bottom end to be an original shape, and to prevent the contents from being moved downward so as to squeeze residual contents well.

BACKGROUND ART

A technique in which two strands of bands formed to have a hook shape are mounted on a bottom end of a tube (a device accompanying the tube when the tube is produced), surround and hold a folded part of the tube and then are fastened and fixed to each other by hooks so as not to unfold and to prevent the contents from being moved downward.

DISCLOSURE

Technical Problem

After using tubular toothpaste, etc., a user folds the bottom of a tube or squeezes it with the help of another device so as to push the contents of the tube toward an exit region. However, due to the characteristic nature of a tube material, a folded part unfolds again which causes inconvenience, such as re-squeezing or squeezing hard every time the tube is used. In addition, a device for squeezing the tube was needed to prevent such inconvenience. However, the device for squeezing the tube also had to be squeezed every time, thus also causing inconvenience. The present invention is directed to fixing a folded tube bottom end so that the tube does not unfold again or so that the contents do not move to the bottom of the tube even without a separate device.

Technical Solution

One aspect of the present invention provides a fixing device for a paste tube such as toothpaste including a tube bottom end formed on one end of the tube to have a certain width and length and a pair of hook parts formed on one surface of the tube bottom end to face each other in a tilted direction along a perforated line cut from one side to the other side in a horizontal direction and the tilted direction, and binding parts formed inside the hook parts. Here, the hook parts may be cut along the perforated line, the hook part on one side and the hook part on the other side may be unfolded and surround a rolled and folded part of the tube bottom end, and the binding parts may come into contact with each other so as to allow hooks to be held by each other.

In the fixing device for a folded paste tube such as toothpaste according to the present invention, a bottom end of the tube may be designed to allow two hooks to come out. Here, when necessary, a folded part of the tube may be surrounded and both hook tips may be connected to each other so as not to unfold the folded tube again.

Advantageous Effects

According to the present invention, when a tube is fixed once using both designed hooks so as not to unfold, it is sufficient to squeeze the contents, such as toothpaste or the like, only by hand for a certain period. Also, when it is necessary to additionally fold the tube, the tube may be simply unfolded and folded again and a folded part is surrounded and held by both hooks. Due to toothpaste, family troubles are caused sometimes, a washstand does not look neat and tidy, or a squeezing device looks messy. However, with the present invention, it is possible to expect a neat bathroom.

MODES OF THE INVENTION

The present invention will be described below in detail with reference to the attached drawings.

Figure 1:
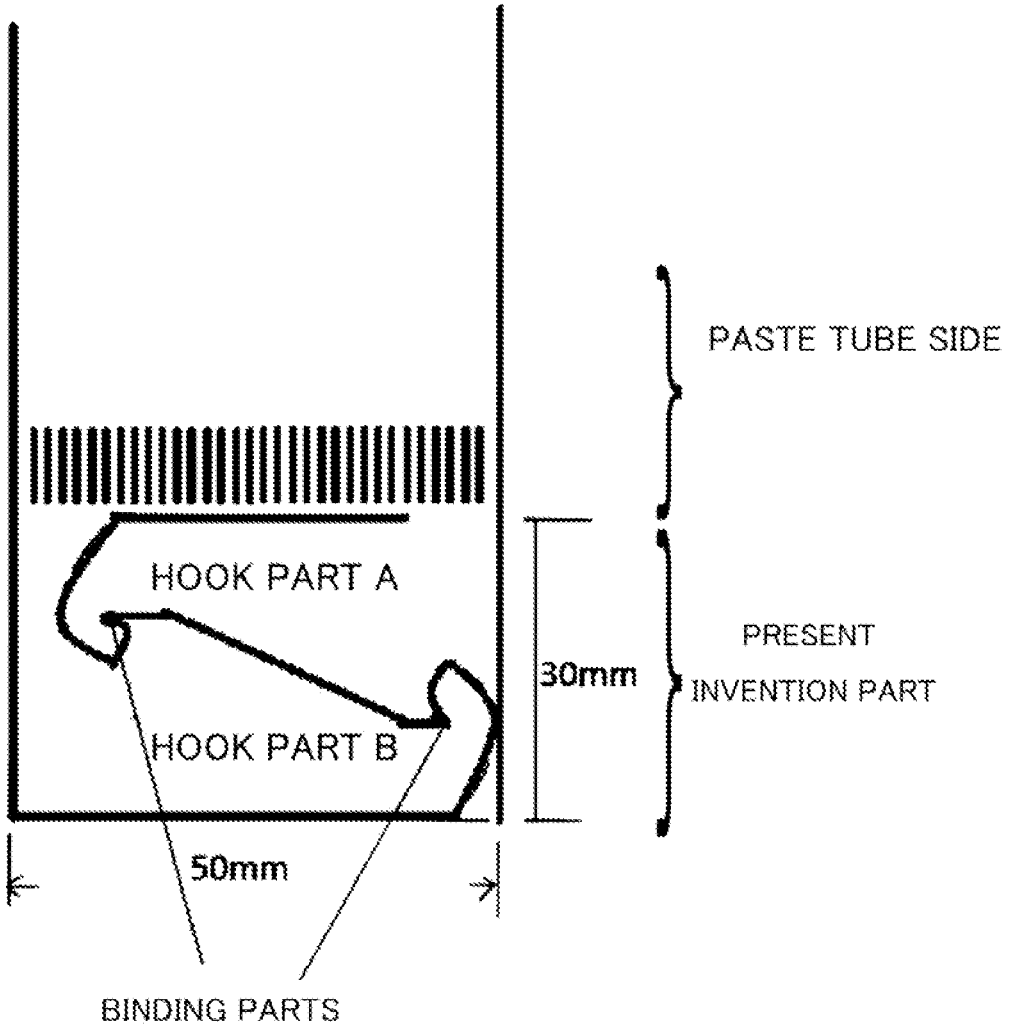
FIG. 1 is an exemplary view illustrating a shape and a size of a device according to the present invention.
Figure 2:
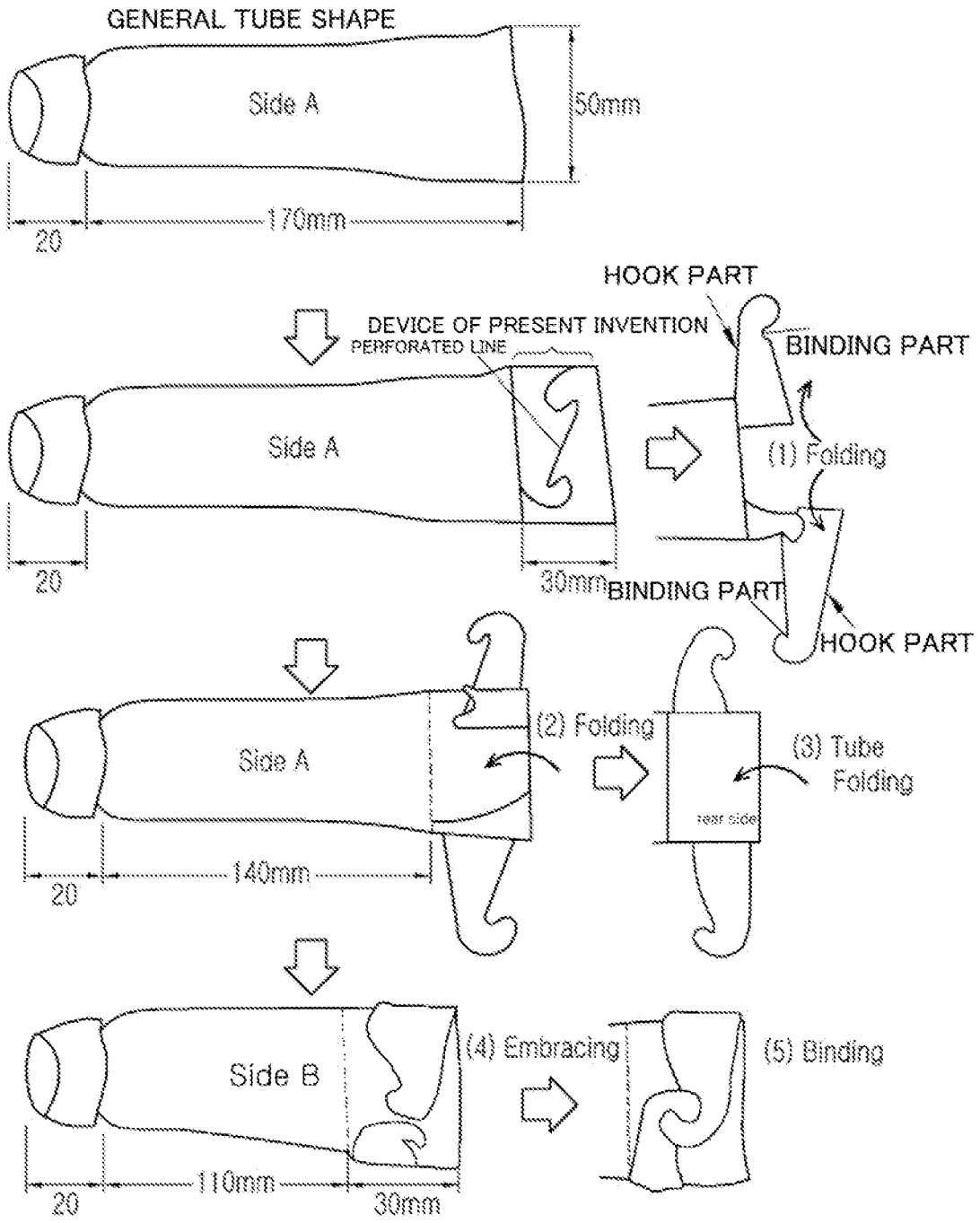
FIG. 2 is a view illustrating the present invention located on a (tooth) paste tube and how to use the present invention.

As shown in FIGS. 1 and 2, a fixing device for a folded paste tube such as toothpaste according to the present invention includes a tube bottom end formed on one end of the tube to have a certain width and length and a pair of hook parts formed on one surface of the tube bottom end to face each other in a tilted direction along a perforated line cut from one side to the other side in a horizontal direction and the tilted direction, and binding parts formed inside the hook parts. Here, the hook parts may be cut along the perforated line, the hook part on one side and the hook part on the other side may be unfolded and surround a rolled and folded part of the tube bottom end, and the binding parts may come into contact with each other so as to allow hooks to be held by each other.

As an example, while manufacturing, a tube manufacturer manufactures a tube bottom end by cutting shapes of a hook part A and a hook part B as shown in FIG. 1. Here, a user does not need to additionally cut.

Also, as shown in FIG. 2, the folded tube is fixed using a device according to the present invention in an order of (1) to (5). (1) First, the hook part A and the hook part B are spread out both ways along the perforated line. (2) The hook part A and the hook part B which are spread out both ways are folded once toward a tube side (side A). (3) The contents are lifted upward (toward an outlet) and an inside of the tube to be folded is flattened and folded once more toward the tube side (side A). (4) An opposite tube side (side B) which is being folded is surrounded by a hook. (5) Both hook parts are held by and fixed to each other. While using the tube, when necessary, the hook parts are unfolded and (3) to (5) of FIG. 2 are performed again.

The invention claimed is:

1. A fixing device for a folded paste tube, the fixing device consisting of a tube bottom end formed on one end of the folded paste tube, the tube bottom end consisting of a pair of hook parts and a pair of binding parts which are in an unlocked relationship, each hook part facing each other and directly contacting with each other along a perforated line cut from one side of the tube bottom end to the other side of the tube bottom end, and each binding part formed inside each hook part, wherein, in a locked relationship, the pair of hook parts are configured to be cut along the perforated line, one hook part on one side of the tube bottom end and the other hook part on the other side of the tube bottom end are unfolded and surround a rolled and folded part of the tube bottom end, and the binding parts come into contact with each other so as to allow hooks to be held by each other.

* * * * *